United States Patent [19]

Abbey

[11] 4,187,805

[45] Feb. 12, 1980

[54] FUEL-AIR RATIO CONTROLLED CARBURETION SYSTEM

[76] Inventor: Harold G. Abbey, 11 Goldsmith Dr., Holmdel, N.J. 07733

[21] Appl. No.: 962,883

[22] Filed: Nov. 22, 1978

Related U.S. Application Data

[63] Continuation-in-part of Ser. No. 919,541, Jun. 27, 1978.

[51] Int. Cl.[2] ..... F02M 9/14

[52] U.S. Cl. ..... 123/28; 123/32 EA; 123/32 EE; 123/32 EH; 123/32 EG; 123/119 C; 123/119 EC; 123/139 AW; 261/69 R; 261/DIG. 56; 261/44 D; 261/39 D; 261/DIG. 64; 261/DIG. 74; 261/DIG. 51

[58] Field of Search ..... 261/DIG. 74, DIG. 56, 261/DIG. 51, 69 R, 44 D, 39 D, DIG. 64; 123/119 EC, 139 AW, 32 EA, 28, 32 EE, 32 EH, 32 EG, 119 C, 119 UC

[56] References Cited

U.S. PATENT DOCUMENTS

| | | | |
|---|---|---|---|
| 1,813,866 | 7/1931 | Royce | 261/44 D |
| 1,983,255 | 12/1934 | Wahlmark | 261/DIG. 56 |
| 2,066,544 | 1/1937 | Shaw | 261/DIG. 56 |
| 2,468,416 | 4/1949 | Stresen-Reuter | 261/DIG. 56 |
| 3,240,191 | 3/1966 | Wallis | 261/DIG. 74 |
| 3,570,824 | 3/1971 | Strohm et al. | 261/DIG. 56 |
| 3,659,572 | 5/1972 | Pelizzoni | 261/DIG. 56 |
| 3,778,038 | 12/1973 | Eversole et al. | 261/DIG. 56 |
| 3,778,041 | 12/1973 | Kincade | 261/DIG. 56 |
| 3,817,225 | 6/1974 | Priegel | 261/DIG. 74 |
| 3,912,796 | 10/1975 | Brown | 261/DIG. 74 |
| 3,956,434 | 5/1976 | Dickensheets et al. | 261/44 F |
| 3,960,118 | 6/1976 | Konomi et al. | 123/32 EE |
| 3,981,284 | 9/1976 | Gospodar | 261/50 A |
| 4,021,513 | 5/1977 | Ullman | 261/DIG. 56 |
| 4,034,028 | 7/1977 | Ma | 261/44 D |
| 4,036,186 | 7/1977 | Hattori et al. | 261/DIG. 74 |
| 4,050,428 | 9/1977 | Masaki | 261/23 A |
| 4,052,968 | 10/1977 | Hattori et al. | 123/32 EE |
| 4,084,562 | 4/1978 | Eckert | 123/119 EC |
| 4,111,169 | 9/1978 | Lawrence | 261/DIG. 74 |
| 4,118,444 | 10/1978 | Abbey | 261/DIG. 56 |

FOREIGN PATENT DOCUMENTS

| | | | |
|---|---|---|---|
| 2014140 | 10/1970 | Fed. Rep. of Germany | 261/DIG. 56 |

*Primary Examiner*—Tim R. Miles

*Attorney, Agent, or Firm*—Michael Ebert

[57] ABSTRACT

An automatic control system for supplying a fuel-air mixture to an internal combustion engine including a variable-Venturi carburetor. Air is fed into the input of the Venturi, the air passing through the throat thereof whose effective area is adjusted by a mechanism operated by a servo motor. Fuel is fed into the input of the Venturi from a fuel reservoir through a main path having a fixed orifice and an auxiliary path formed by a metering valve operated by an auxiliary fuel-control motor. The differential air pressure developed between the inlet of the Venturi and the throat thereof is sensed to produce an air-velocity command signal that is applied to a controller adapted to compare the command signal with the servo motor set point to produce an output for governing the servo motor to cause it to seek a null point, thereby defining a closed process control loop. The intake manifold vacuum, which varies in degree as a function of load and speed conditions is sensed to govern the auxiliary fuel-control motor accordingly, is at the same time converted into an auxiliary signal which is applied to the controller in the closed loop to modulate the command signal in a manner establishing an optimum air-fuel ratio under the varying conditions of load and speed.

17 Claims, 3 Drawing Figures

FUEL-AIR RATIO CONTROLLED CARBURETION SYSTEM

RELATED APPLICATION

Figure 1:
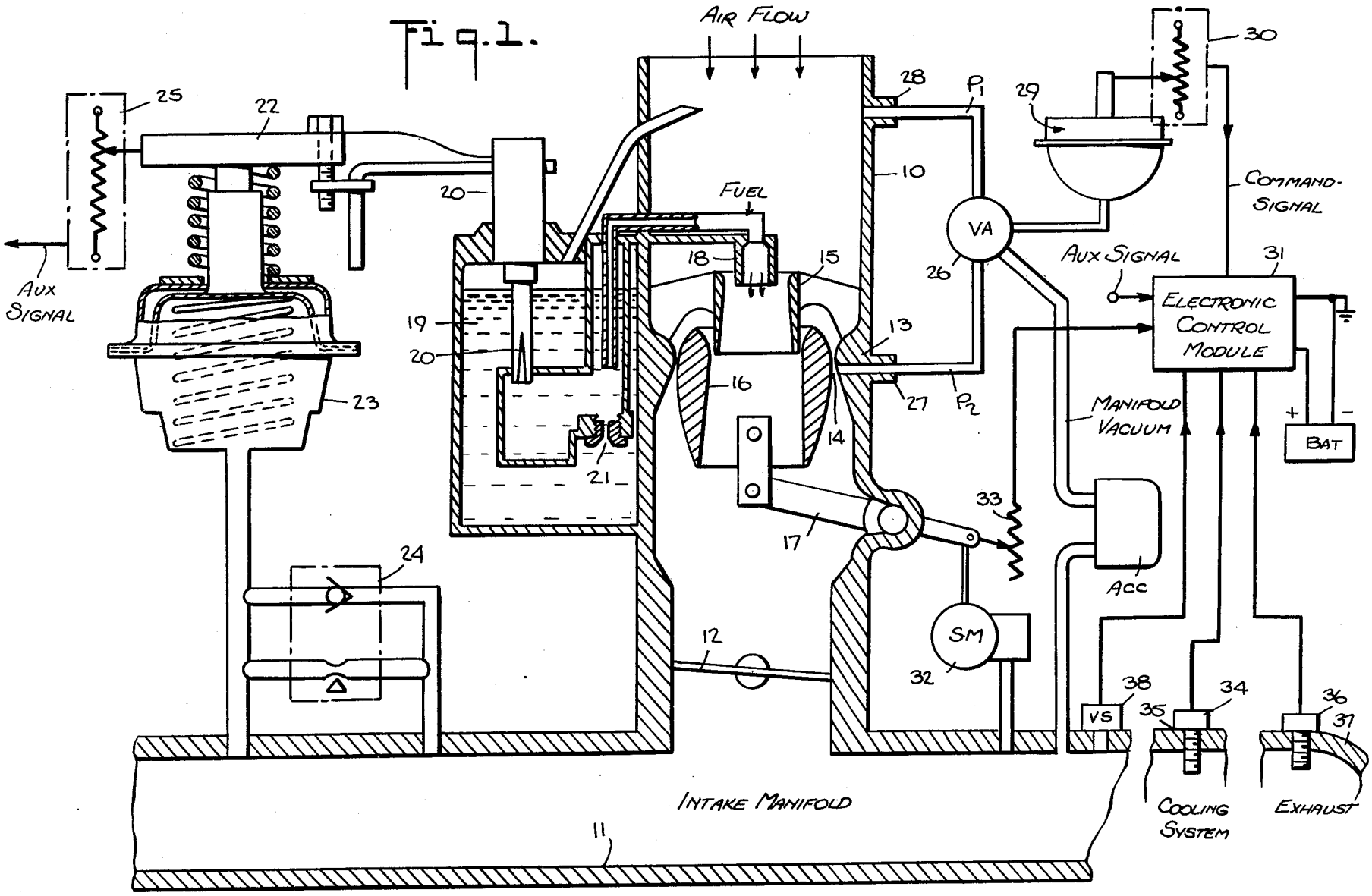

This application is a continuation-in-part of my copending application Ser. No. 919,541, filed June 27, 1978, entitled "Variable Venturi Carburetion System."

BACKGROUND OF INVENTION

This invention relates generally to variable Venturi carburetion systems for supplying a fuel-air mixture to the internal combustion engine of an automotive vehicle, and more particularly to a system for automatically controlling the flow of fuel and air admitted into the Venturi to maintain a desired ratio thereto under varying conditions of load and speed.

The function of a carburetor is to produce the fuel-air mixture needed for the operation of an internal combustion engine. In the carburetor, the fuel is introduced in the form of tiny droplets in a stream of air, the droplets being vaporized as a result of heat absorption in a reduced pressure zone on the way to the combustion chamber whereby the mixture is rendered inflammable.

In a conventional carburetor, air flows into the carburetor through a Venturi tube which is generally circular in shape. The reduction in pressure at the Venturi throat causes fuel to flow from a float chamber in which the fuel is stored through a fuel jet into the air stream, the fuel being atomized because of the difference between air and fuel velocities.

The behavior of an internal combustion engine in terms of operating efficiency, fuel economy and emission of pollutants is directly affected by the fuel-air ratio of the combustible charge. Under ideal circumstances, the engine should at all times burn 14.5 parts of air to one part of fuel to satisfy the stoichiometric air-to-fuel ratio. But in actual operation, this ratio varies as a function of operating speed and is affected by changes in load and temperature.

To obtain maximum economy, the fuel-to-air ratio in the mixture should be maintained within close tolerances in all modes of operation, such as "idle" while standing still, "slow-speeds" up to about 20 miles an hour, "cruising speeds" and "high-speeds." The conventional practice is to provide an accelerating pump system to furnish an extra charge of fuel for accelerations, a choke system to enrich the mixture for starting a cold engine and a throttle by-pass jet for idle and slow speed, as well as a power jet or auxiliary barrels for high speed or high power operation, all in addition to the main jet.

Another reason why the maintenance of a steady fuel-to-air ratio is important is that the emission of pollutants is in large measure governed by this ratio. Thus, when the mixture is relatively low in air, carbon monoxide is produced, and when the ratio is excessively rich in fuel, unburned hydrocarbons are emitted in the exhaust.

A major problem encountered in carburetion is to secure the correct amount of suction around the main jet at slow engine speeds and yet allow enough air to enter at high engine speeds to maintain the desired ratio of air and fuel. Venturi size must, of necessity, represent a compromise for both high and low speed operation. Because the maximum power an engine can develop is limited by the amount of air it can breathe in, the Venturi size should offer minimum resistance to the larger volume of air flowing at high engine speed. On the other hand, a small Venturi is desirable at low engine speeds to afford sufficient air velocity for controllable fuel metering and good fuel atomization.

The modern approach to this problem is the use of two or more Venturis arranged in series and/or two or more barrels in parallel. The multiple Venturi design serves two purposes: First, the added Venturis build up air velocity in the smaller primary Venturi, thereby augmenting the force available at the main nozzle for drawing and atomizing fuel. Second, air bypassing the primary Venturi forms an air cushion around the rich mixture discharged by the Venturi, tending to improve mixture distribution by preventing fuel from engaging the carburetor walls. Idle or very slow speed is invariably served by an auxiliary jet around the edge of the throttle plate.

However, the typical modern carburetor requires a series of additional jets and pumping systems that cut in and out as the carburetor velocity increases and decreases above and below average speed, and as the engine operation passes through successive operating modes of acceleration, cruising, high speed and deceleration. Idle or very slow speed operations both rely on an idle jet arrangement at the closed position of the butterfly throttle valve. The actions of these auxiliary devices give rise to large fluctuations in the air-fuel ratio and thereby adversely affect fuel economy.

But fuel economy is not the only reason for maintaining a steady air-to-fuel ratio; for, as pointed out in *Business Week* (June 21, 1976), though a new catalytic converter is available which is adapted to limit the emission of hydrocarbons, carbon monoxide and nitrogen oxides, "A steady ratio (air-to-fuel) is crucial to the new converter because it must simultaneously harbor conflicting chemical reactions." As pointed out in this article, "in actual operation, the ratio fluctuates with acceleration and deceleration."

Although fuel-air mixtures may be introduced to the combustion chambers of an engine by means other than carburetors, as by fuel injection, supercharging and other expedients, none of these is comparable in effectiveness with the Venturi principle for efficient atomization of volatile fuels.

Attempts have heretofore been made to provide variable-Venturi carburetors to tailor the air-fuel supply to changing engine conditions. Thus U.S. Pat. Nos. 2,066,544; 3,659,572 and 3,778,041 show various embodiments of a variable-Venturi carburetor. But the arrangements disclosed in these patents are incapable of varying the effective parameters of a Venturi tube so as to maintain the optimum shape and area ratios of the tube throughout the operating range and to properly locate the fuel nozzles or jets in a continuously changing Venturi throat.

The throat of a Venturi, as this term is used herein, refers to that cross-section of the air-flow passage in the Venturi that is either the smallest or through which the air flow velocity is greatest, or conversely in which the static pressure is lowest.

In my above-identified copending application Ser. No. 919,541, filed June 27, 1978, entitled "Variable Venturi Carburetion System" whose entire disclosure is incorporated herein by reference, there is disclosed a carburetion system for supplying a fuel-air mixture to an internal combustion engine in a manner maintaining a desired fuel-air ratio under varying conditions of engine demand.

The system disclosed in my copending application includes a variable-Venturi structure having a converging inlet supplying incoming air to a throat coupled to a diverging outlet leading into a throttle chamber, the effective area of the throat being adjustable by a control mechanism. A motor is operatively coupled to this control mechanism as well as to a fuel metering device feeding fuel at an adjustable flow rate into the Venturi structure to be intermingled with the air passing through this structure.

The pressure differential between air pressure at the upstream Venturi input and at the throat thereof is sensed to produce a signal that depends on the effective area of the throat and is a function of the velocity of air passing through the Venturi. This signal is applied to a controller where it is compared to a set point to produce a control signal that is applied to the motor which acts not only to adjust the control mechanism for varying the effective area of the throat but also serves to adjust the fuel metering device to an extent maintaining a desired fuel-to-air ratio under varying conditions of engine demand.

While the system disclosed in my copending application is responsive to certain operating conditions and represents an improvement over prior carburetion systems, it is incapable of taking into account all conditions of load and speed actually experienced with an engine, and it does not, therefore, always maintain a fuel-to-air ratio that is optimized for automotive operating conditions.

SUMMARY OF INVENTION

In view of the foregoing, the main object of this invention is to provide an automatically-controlled carburetion system which maintains that ratio of air-to-fuel which represents the optimum ratio for the prevailing conditions of load and speed to effect a marked improvement in fuel economy and to substantially reduce the emission of noxious pollutants.

More particularly, it is an object of this invention to provide a system of the above type which includes variable-Venturi structure to which air and fuel are supplied, the flow of air being controlled by a closed process control loop having a controller responsive to a command signal that is modulated as a function of load and speed conditions.

Also an object of the invention is to provide an automatic control system which maintains an optimum ratio of fuel and air, which system operates efficiently and reliably and yet lends itself to low-cost mass-production.

Briefly stated, an automatic system in accordance with the invention includes a variable-Venturi carburetor for intermingling air and fuel and for feeding the air-fuel mixture in an appropriate ratio into the throttle inlet of the manifold. Air is fed into the input of the Venturi, the air passing through the throat thereof whose effective area is adjusted by a mechanism operated by a servo motor. Fuel is fed into the input of the Venturi from a fuel reservoir through a main path having a fixed orifice and an auxiliary path formed by a metering valve operated by an auxiliary fuel-control motor. The differential air pressure developed between the inlet of the Venturi and the throat thereof is sensed to produce an air-velocity command signal which is applied to a controller adapted to compare this signal with the set point of the servo motor to produce an output for governing the servo motor to cause it to seek a null point, thereby defining a closed process control loop.

The intake manifold vacuum which varies in degree as a function of load and speed conditions is sensed to govern the auxiliary fuel-control motor accordingly and is, at the same time, converted into an auxiliary signal which is applied to the controller in the closed loop to modulate the command signal in a manner maintaining an optimum air-fuel ratio under the varying conditions of load and speed.

Thus the flow of air through the Venturi is controlled as a function of throat air velocity by a closed process control loop whose air velocity command signal is modulated by an auxiliary signal reflecting the degree of intake manifold vacuum developed under the prevailing conditions of speed and load. In this way, the flow of air and fuel in the carburetor are correlated to cope with transitions through the modes of automatic operation smoothly and without hesitation within prescribed desirable ratios.

OUTLINE OF DRAWINGS

Figure 2:
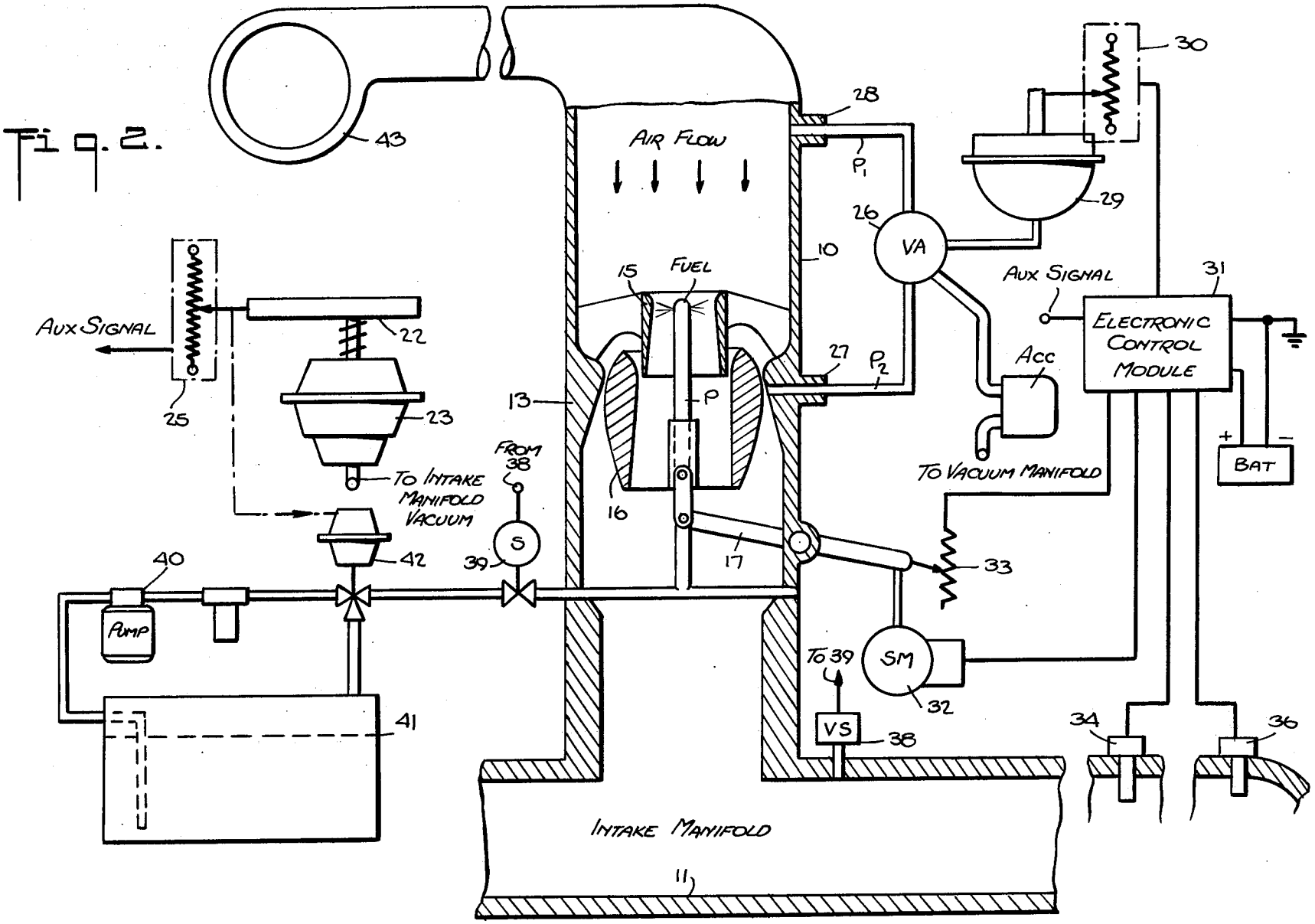
Figure 3:
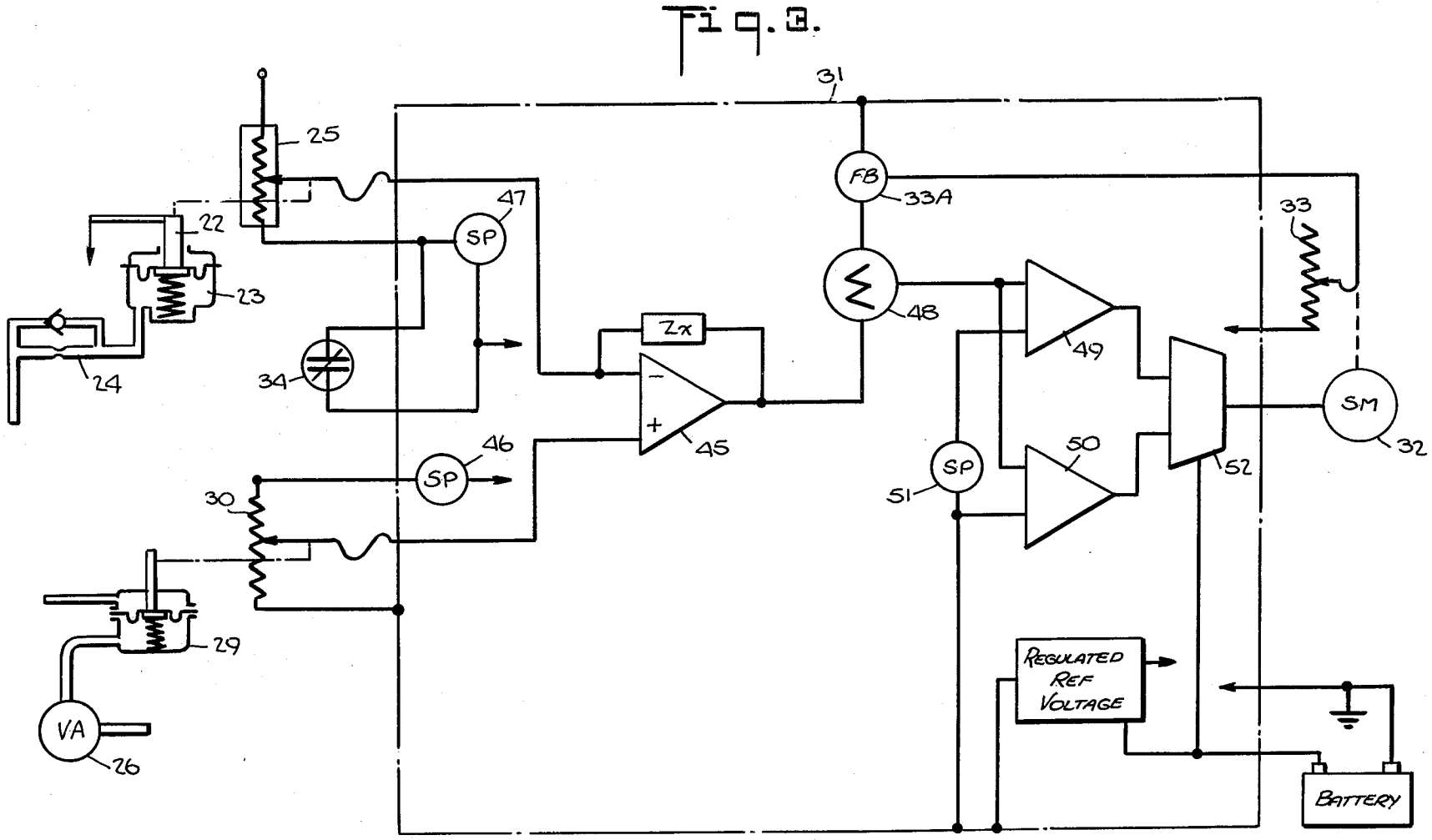

For a better understanding of the invention as well as other objects and further features thereof, reference is made to the following detailed description to be read in conjunction with the accompanying drawings, wherein:

FIG. 1 schematically illustrates a first preferred embodiment of an automatically-controlled variable-Venturi carburetor system in accordance with the invention;

FIG. 2 schematically illustrates a second preferred embodiment of the invention; and FIG. 3 is a block diagram of the electronic circuit of the control system shown in FIG. 1.

DESCRIPTION OF INVENTION

First Embodiment Structure

While a system in accordance with the invention is operable with any of the variable-Venturi structures disclosed in my above-indentified copending patent application, use is preferably made of a three-stage variable-Venturi structure of the type shown in FIG. 1 having a tubular casing 10 into which an air stream at atmospheric pressure is introduced. The lower end of casing 10 is coupled to the intake manifold 11 of the internal combustion engine through a foot-operated throttle inlet 12.

Disposed in the mid-section of casing 10 is a stationary ring 13 having an internal Venturi configuration which defines a Venturi throat 14 that surrounds the outlet of a Venturi booster 15 also having an internal Venturi configuration mounted coaxially within the casing. The Venturi structure is completed by a cylindrical spool 16 having an external/internal Venturi configuration that is axially movable by means of a lever 17 pivoted on the casing 10. The lever acts to shift spool 16 upwardly toward the outlet of booster 15 to constrict throat 14 or to shift the spool downwardly to enlarge the effective area of the throat.

A fuel nozzle 18 which supplies fuel into the upper end of booster 15 is coupled to a fuel reservoir 19 by way of a main path which feeds a minimum amount of fuel through a fixed jet orifice 21 and by way of an auxiliary path including a metering valve 20 having a linear variable orifice which feeds a controllable amount of auxiliary fuel. Auxiliary fuel metering valve 20 is operated by the spring-biased air motor 22 of a vacuum sensor 23. This sensor is coupled through a damper valve 24 to the intake manifold 11. The position of vacuum sensor motor 22, which depends on the degree of vacuum, is converted into a corresponding auxiliary signal by a manifold vacuum transducer 25. In practice, this transducer may simply be a potentiometer whose slider is operatively coupled to sensor motor 22.

A vacuum amplifier 26 is coupled to a sensing tap 27 communicating with throat 14 of the Venturi structure and a sensing tap 28 at the upstream end of the structure, the output of amplifier 28 being coupled to an air velocity sensor motor 29. The prevailing pressure differential $P_1-P_2$ developed between taps 27 and 28 is sensed and amplified to produce a strong linearly proportional vacuum signal from the intake manifold source assisted by a vacuum accumulator ACC. This air velocity signal operates sensor 29 coupled to transducer 30 to produce an electrical command signal proportional to the velocity of air passing through the Venturi throat.

The command signal from transducer 30 is applied to an electronic controller 31 which compares this signal with the set point of servo motor 32 to produce an output for governing the operation of this motor. Servo motor 32 drives lever 17, thereby defining a closed process control loop in which one variable is the air velocity through the Venturi throat. The loop serves to adjust the Venturi throat area to thereby vary the air velocity so that it complies to the set point setting. Servo motor 32 operates a position feedback transducer 33 whose output is fed to the controller to indicate the existing position of the motor. The air velocity command signal applied to controller 31 is modulated by the auxiliary signal yielded by the intake manifold vacuum transducer 25 so that the operation of the controller is responsive to another variable proportional to prevailing conditions of speed and load.

The air-velocity command signal from transducer 30 and the auxiliary signal from transducer 25 are further modified by control signals derived from an engine-temperature switch 34 in the engine cooling system 25 and an engine-exhaust emission transducer 36 placed in the engine exhaust pipe 37. A vacuum switch 38 is coupled to the manifold and is normally closed in the absence of a vacuum, the switch being coupled to controller 31.

First Embodiment Operation

The air velocity through throat 14 of the Venturi, as indicated by the value of differential pressure $P_1-P_2$ is converted by transducer 30 into a variable d-c command signal which is applied to controller 31 for comparison with the set point of servo motor 32. Controller 31 yields an output which governs the servo motor 32 which, in practice, may be a pneumatic or electric motor, causing motor 32 to adjust the position of the Venturi spool 16 and the resultant area of the throat to bring about a change in air velocity until the servo motor attains its null position as determined by its set point. Thus the controller, the motor and the associated elements constitute the components of a closed air process control loop.

In practice, the intake manifold vacuum varies from zero to twenty inches of mercury or more under the load and speed conditions encountered in normal engine operation. Thus accelerating or heavy loads with slow to moderate speeds results in a low to increasing vacuum in a range extending from about 2 inches of mercury to a maximum of 10 to 15 inches. Cruising represents a condition of medium load at average speed or light load at high speed, this condition resulting in an intake manifold vacuum of from 20 inches or more of mercury down to approximately 15 inches vacuum.

The load and demand imposed on the engine is reflected by the intake manifold pressure. In the present arrangement, the vacuum-responsive motor 23 is designed for linear movement in a vacuum range of 0 to 20 inches mercury, this motor being directly connected to metering valve 20 in the auxiliary fuel path.

Thus a low vacuum in the intake manifold causes motor 23 to open fuel metering valve 20, whereas a high vacuum brings about closure of this valve. Concurrently with this action, motor 23 operates transducer 25 to produce an auxiliary signal that is applied to the controller of the closed process air loop to modulate the command signal reflecting air velocity as a function of the prevailing vacuum in the intake manifold.

The intake manifold vacuum sensor 23 therefore not only controls the flow of auxiliary fuel into the Venturi but through its associated transducer 25 which develops an auxiliary signal that depends on the prevailing vacuum in the intake manifold, but it also acts to modulate the closed air loop to either increase or decrease air velocity. This in turn brings about, as a result of the changing throat pressure, an increase or decrease of fuel flow into the Venturi.

In this way, the fuel metering system is not only responsive to the engine's demand for more or less fuel, but it functions by way of its auxiliary signal applied to the closed process control air loop to so modify the ratio of air-to-fuel until the ratio is at the optimum value for the prevailing conditions of load and speed.

Damper valve 24 in the manifold vacuum line controlling the auxiliary fuel supply and the resultant auxiliary signal functions as a rate-of-change modulator, so that the transitions from acceleration to deceleration in the various modes of operation are effectively bumpless and match the driving characteristics of the vehicle. In this way, the operation is free of hesitation and the car performance is smooth, economical and efficient in all modes of operation. In practice, damper 24 may be an adjustable flow check valve, an accumulator with bypass orifices or other fluidic combinations.

The operations above-described are those encountered under normal conditions of start-up and engine temperature. To effect cold temperature enrichment, the engine temperature thermostatic switch 34 acts to cut in resistance in the controller circuit to provide a richer fuel-air ratio when the thermostatic switch senses a cold engine temperature and is opened thereby. Thereafter, when the engine warms up, this switch is closed to bypass the inserted resistance and thereby restore the leaner fuel-air ratio appropriate to operation at normal temperatures.

For emission control, exhaust-gas sensor 36, which may be of any known conductivity or excess oxygen type, after a normal engine temperature is achieved, acts to further limit the richness of the air-fuel ratio by raising the set point in the controller 31 to increase the ratio of air-to-fuel. It is well known that the leaner the mixture, the lesser the amount of unburned hydrocarbons produced in the engine. This sensor can serve as a limiting factor that is operative after the engine is hot, so that one can control the minimum air-to-fuel ratio and thereby prevent over-enrichment in normal operation.

Vacuum switch 38 acts in a manner equivalent to a starting choke. Where there is no vacuum, this indicates that the engine is not operating and the vacuum switch then acts to shift the variable-Venturi to its minimum position by causing servo motor 32, under the control of controller 31, to seek its minimum position. After the engine starts, the resultant vacuum in the intake manifold acts to open switch 38, thereby restoring the normal air flow signal, the Venturi system then being operated by all the other controls.

Second Embodiment

The first embodiment deals with an engine working with below-atmospheric induction, as in conventional carburetors or fuel injection systems. The control system in accordance with this embodiment adapts to these conventional engines by means of its below-atmospheric air intake and below-atmospheric fuel induction by a carburetion action from a float controlled fuel supply. In this first arrangement, the air flow sensor can be controlled only from the Venturi vacuum, considering the atmosphere as a basic plenum. However, in the case of above-atmospheric arrangements, such as in the new supercharged engines, it is obvious that a pressurized fuel supply is required.

To this end, as shown in FIG. 2, in conjunction with air booster or supercharger 43, we provide an air flow sensor 29, the upstream pressure tap 28 being placed in the pressurized air discharge into the Venturi structure. Thus the pressure drop from the above-atmospheric intake air pressure to the reduced Venturi throat pressure as sensed at tap 27 affords a direct measurement of air velocity.

Also in this embodiment, instead of a fuel nozzle as in FIG. 1, a spray jet J disposed at the head of a center pipe P coaxially disposed in casing 10 is provided to eject the fuel at right angles to the direction of air flow at the throat of the primary Venturi booster 15. Coupled to fuel pipe P is a pressurized fuel supply constituted by a fuel tank 41 whose output is fed by a fuel pump 40 through a pressure-regulating valve 42 and a solenoid valve 39 to the fuel pipe.

Pressure regulating valve 42 acts to govern fuel pressure so that it is inversely proportional to the intake manifold vacuum. This is effected by operatively coupling the vacuum sensor motor 22 to valve 42, or by having the valve directly operated by the intake manifold vacuum. Fuel flow regulator valve 42 supplies fuel from a minimum to a maximum pressure level.

Thus the fuel flow rate is again metered by the intake manifold vacuum, while the air velocity set point is also being modulated by transducer 25 whose auxiliary signal is applied to electronic control module 31 in the same manner as in the first embodiment.

Vacuum switch 28, which acts as a choke in the first embodiment, cuts off fuel flow in the second embodiment by closing solenoid valve 39 when the engine is stopped. Fuel flow for starting is controlled by the ignition switch "start" or "cranking" position until the vacuum switch takes over when the engine starts.

Thus the principles of control which regulate the fuel-to-air ratio under varying conditions of load and speed in the second embodiment are essentially the same as in the first embodiment, except for the means for metering fuel flow, the second embodiment operating with the same efficiency of air induction and fuel gasification.

Controller Electronic Circuits

Referring now to FIG. 3, there is shown in block diagram form the electronic circuits included in controller 31 whose output is applied to servo motor 32 which drives the mechanism for adjusting the effective area of the Venturi throat to establish a desired air flow velocity.

Controller 31 is provided with a differential amplifier 45 to one input of which is applied the air-velocity command signal derived from transducer 30. This transducer is operatively coupled to air-velocity sensor motor 29 responsive to the air-pressure differential $P_1 - P_2$ developed in the Venturi structure. Transducer 30 is provided with an air velocity set-point adjuster 46 capable of setting the set point for the command signal to the leanest air-to-fuel ratio.

Applied to the other input of differential amplifier 45 is the auxiliary fuel signal derived from transducer 25 which is operatively linked to the vacuum-sensing motor 23 coupled to the intake manifold which acts also to adjust the auxiliary fuel metering valve.

The auxiliary fuel signal from transducer 25 is modified by the engine-temperature switch 34 which opens when the temperature in the cooling system is cold and closes when it is hot, the open switch interposing a cold enrichment set point adjuster 47 in the auxiliary signal circuit which is shunted out by the closed temperature switch when hot.

The output of differential amplifier 45 is therefore constituted by the air-velocity command signal as modulated by the auxiliary fuel signal and further modified by the temperature-sensing and exhaust-sensing elements included in the system. This output is applied to one input of a summing junction 48 to whose other input is applied the servo-motor feedback voltage from transducer 33. This feedback voltage depends on the setting of the servo motor and hence on the position of the Venturi throat adjustment mechanism. Feedback adjuster 33A sets the sensitivity of response of servo motor 32.

The output of summing junction 48 is fed to a pair of differential amplifiers 49 and 50 forming a comparator with respect to a servo null bandwidth adjuster 51 which establishes the null set point of the servo motor. The output of the comparator goes to the drive amplifier 52 for the servo motor.

Thus the operation of the closed process control loop which includes servo motor 32 for varying the effective area of the throat in the Venturi structure is responsive to the air-velocity command signal as modulated by the auxiliary fuel signal reflecting the flow of auxiliary fuel into the Venturi as determined by the intake manifold vacuum, and as further modified to take into account the operating temperature of the engine and the degree of pollutants in the exhaust.

In this way, all of the interacting and interrelated factors that are involved in the behavior of the engine serve to automatically regulate the ratio of air-to-fuel to attain the optimum ratio for the prevailing conditions of speed and load.

The circuit shown in FIG. 3 is designed for the first embodiment of the control system, but can readily be adapted to work with the second embodiment.

While there have been shown and described preferred embodiments of a fuel-air ratio controlled carburetion system in accordance with the invention, it will be appreciated that many changes and modifications may be made therein without, however, departing from the essential spirit thereof.

I claim:

1. An automatic control system for supplying a fuel-air mixture to the inlet of the intake manifold of the internal combustion engine of a vehicle for regulating the ratio of air to fuel so that this ratio is optimized for prevailing conditions of engine speed and load, said system comprising:

A. a variable Venturi structure whose input is coupled to a source of combustion air and whose output is coupled to the inlet of said intake manifold, said structure including a throat and a mechanism to adjust the effective area thereof;

B. a servo motor operatively coupled to said mechanism to adjust the area of said throat;

C. fuel supply means including a metering valve which controls an auxiliary amount of the fuel to feed fuel into said Venturi structure to be intermixed with said air;

D. an auxiliary fuel-control motor operatively coupled to said valve to adjust the auxiliary fuel feed thereof;

E. means to sense the difference in air pressure existing between the input to the Venturi structure and its throat to generate a command signal indicative thereof;

F. a controller responsive to said command signal to compare said signal with a servo motor set point to produce an output which is applied to the servo motor to adjust said throat area in a direction and to an extent causing the velocity of air through said Venturi structure to comply with said set point; said controller, said servo motor and said means to sense air pressure constituting a closed process control loop;

G. means to sense the degree of vacuum in said intake manifold to control said auxiliary fuel-control motor to adjust the auxiliary fuel feed accordingly, said degree of vacuum reflecting the prevailing conditions of speed and load;

H. a transducer coupled to said auxiliary fuel-control motor to produce an auxiliary signal proportional to the degree of vacuum; and I. means to apply said auxiliary signal to said controller in said loop to modulate said command signal to cause the rate of air flow through said Venturi structure to assume a value relative to the rate of fuel flow at which the resultant ratio is optimized with respect to said prevailing conditions of speed and load.

2. An automatic control system, as set forth in claim 1, wherein said engine includes an exhaust and further including means to sense the level of pollutants emitted through said exhaust to produce a signal which is applied to said controller to so modify the fuel-air ratio as to reduce said level.

3. An automatic control system, as set forth in claim 1, wherein said engine includes a cooling system having a temperature sensor therein to produce a signal which is applied to said controller to so modify the fuel-air ratio as to enrich said fuel under cold temperature conditions.

4. An automatic control system, as set forth in claim 1, further including a vacuum switch coupled to said manifold to produce a switching action in said controller in the absence of a vacuum to effect choking.

5. A system as set forth in claim 1, wherein said means to sense differential pressure includes a tap at the upper end of the Venturi structure and tap at the throat thereof.

6. A system as set forth in claim 1, further including a foot-operated throttle in the inlet to the intake manifold.

7. A system as set forth in claim 1, further including a fixed orifice in said fuel supply means to assure a minimum main feed thereof.

8. A system as set forth in claim 1, further including means to regulate the rate of change of the auxiliary signal to provide a performance free of hesitation through the transitions encountered in varying modes of operation.

9. A system as set forth in claim 1, further including means to regulate the rate of change of the auxiliary fuel supply to provide smooth and economical performance through varying modes of operation.

10. A system as set forth in claim 1, further including a booster pump to supply pressurized air to said Venturi structure.

11. A system as set forth in claim 10, wherein said fuel metering valve is a pressure-regulating valve, and further including pump means to supply fuel from a reservoir through said valve.

12. An automatic control system for supplying a fuel-air mixture to the inlet of the intake manifold of the internal combustion engine of a vehicle for regulating the ratio of air to fuel so that this ratio is optimized for prevailing conditions of engine speed and load, said system comprising:

A. a variable Venturi structure whose input is coupled to a source of combustion air and whose output is coupled to the inlet of said intake manifold, said structure including a throat and a mechanism to adjust the effective area thereof;

B. a signal-responsive closed process control loop including a servo motor coupled to said mechanism to adjust the effective area of said Venturi throat;

C. means to sense the velocity of air passing through said Venturi structure to produce an air velocity command signal which is applied to the input of said loop to cause said servo motor to effect an adjustment in accordance therewith;

D. means including a metering valve to feed fuel into said Venturi structure to be intermixed with said air therein;

E. means to adjust said valve in accordance with the degree of vacuum in said intake manifold; and F. means responsive to the valve adjustment to produce a signal that reflects said degree of vacuum and to modulate said command signal with said vacuum signal to provide the desired air-to-fuel ratio.

13. A system as set forth in claim 12, wherein said variable Venturi structure is constituted by a cylindrical casing provided with a stationary ring having an internal Venturi configuration that defines a throat that surrounds the outlet of a Venturi booster also having an internal Venturi configuration, and a cylindrical spool having an external/internal Venturi configuration that is axially shiftable with respect to the outlet of the booster to vary the constriction of the throat.

14. A system as set forth in claim 13, further including a lever pivoted on said casing and operatively coupled to said spool, said lever being swung by said servo motor to shift the spool position.

15. A system as set forth in claim 13, wherein said fuel is fed into the Venturi structure by a nozzle located at the inlet to said booster to feed fuel downwardly through said booster.

16. A system as set forth in claim 13, wherein said fuel is fed into said Venturi structure by a spray jet at the head of a fuel pipe coaxially centered within said casing and extending into said booster.

17. A system as set forth in claim 16, wherein said spray jet emits fuel at right angles to the direction of air flow through said booster.

* * * * *